US009388632B2

(12) United States Patent
Strand

(10) Patent No.: US 9,388,632 B2
(45) Date of Patent: Jul. 12, 2016

(54) CORD LOCK ASSEMBLY

(71) Applicant: Hunter Douglas, Inc., Pearl River, NY (US)

(72) Inventor: Toralf Strand, Kittery Point, ME (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/585,289

(22) Filed: Dec. 30, 2014

(65) Prior Publication Data

US 2015/0184454 A1 Jul. 2, 2015

Related U.S. Application Data

(60) Provisional application No. 61/922,183, filed on Dec. 31, 2013.

(51) Int. Cl.

| | |
|---|---|
| ***E06B 9/324*** | (2006.01) |
| ***E06B 9/262*** | (2006.01) |
| ***E06B 9/322*** | (2006.01) |
| ***E06B 9/323*** | (2006.01) |

(52) U.S. Cl.

CPC ..... *E06B 9/324* (2013.01); *E06B 9/262* (2013.01); *E06B 9/322* (2013.01); *E06B 9/323* (2013.01); *E06B 2009/2625* (2013.01)

(58) Field of Classification Search

CPC ..... E06B 9/32; E06B 9/32442; E06B 9/78; E06B 9/785; E06B 9/324

USPC ..... 160/178.2, 319

See application file for complete search history.

(56) References Cited

U.S. PATENT DOCUMENTS

| | | | | |
|---|---|---|---|---|
| 4,646,808 | A * | 3/1987 | Anderson | E06B 9/324 160/178.2 |
| 4,722,383 | A * | 2/1988 | Kross | E06B 9/324 160/168.1 R |
| 4,945,970 | A * | 8/1990 | Marocco | E06B 9/305 160/178.2 |
| 7,775,254 | B2 * | 8/2010 | Judkins | E06B 9/324 160/178.2 |
| 8,210,227 | B2 * | 7/2012 | Hoffmann | E06B 9/324 160/178.2 |
| 2005/0056384 | A1 * | 3/2005 | Dekker | E06B 9/324 160/178.2 |
| 2006/0118248 | A1 * | 6/2006 | Anderson | E06B 9/262 160/84.04 |
| 2007/0044925 | A1 * | 3/2007 | Huang | E06B 9/324 160/178.2 |
| 2008/0041535 | A1 * | 2/2008 | Judkins | E06B 9/324 160/178.2 |
| 2010/0236731 | A1 * | 9/2010 | Cheng | E06B 9/324 160/405 |
| 2011/0126994 | A1 * | 6/2011 | Anderson | E06B 9/262 160/405 |
| 2013/0062022 | A1 * | 3/2013 | Anderson | E06B 9/262 160/84.04 |

* cited by examiner

*Primary Examiner* — David E Allred
*Assistant Examiner* — Scott Denion
(74) *Attorney, Agent, or Firm* — Dority & Manning, P.A.

(57) ABSTRACT

A cord lock assembly for a shade assembly is provided. The cord lock assembly may include a spool rotatably attached to a housing, with the housing defining a pull cord channel. A pull cord may be provided that extends through the pull cord channel and wraps at least partially around the spool. The pull cord channel may include a roller configured to interact with the pull cord and a rear wall of the pull cord channel such that it may move between a locked and an unlocked position based at least in part by the angle at which the pull cord is held relative to a plane defined the shade assembly.

15 Claims, 14 Drawing Sheets

SECTION A–A

SECTION A–A

SECTION B–B

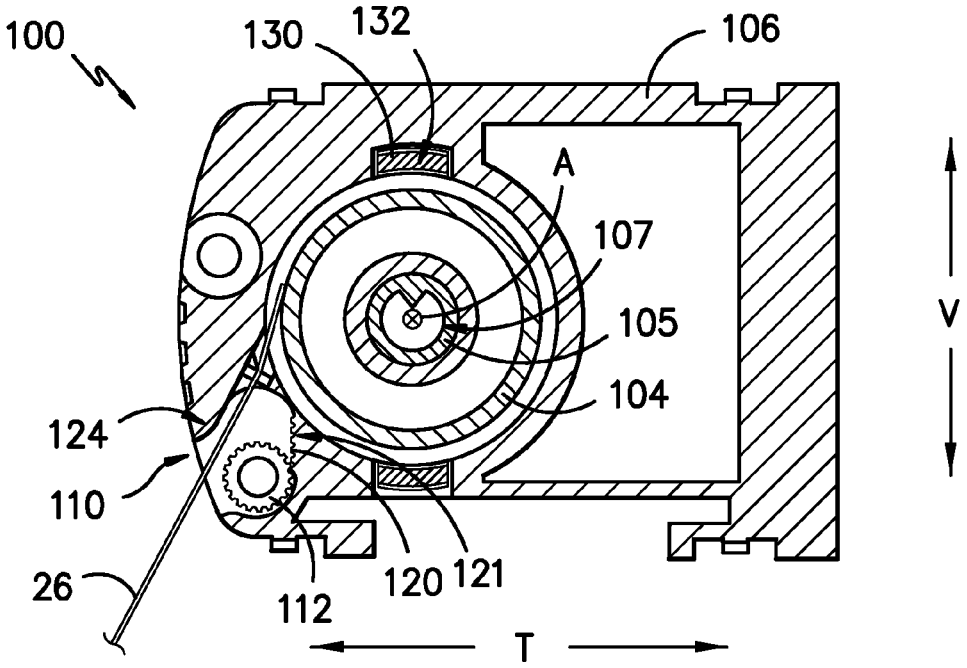
SECTION A–A
FIG. –14–
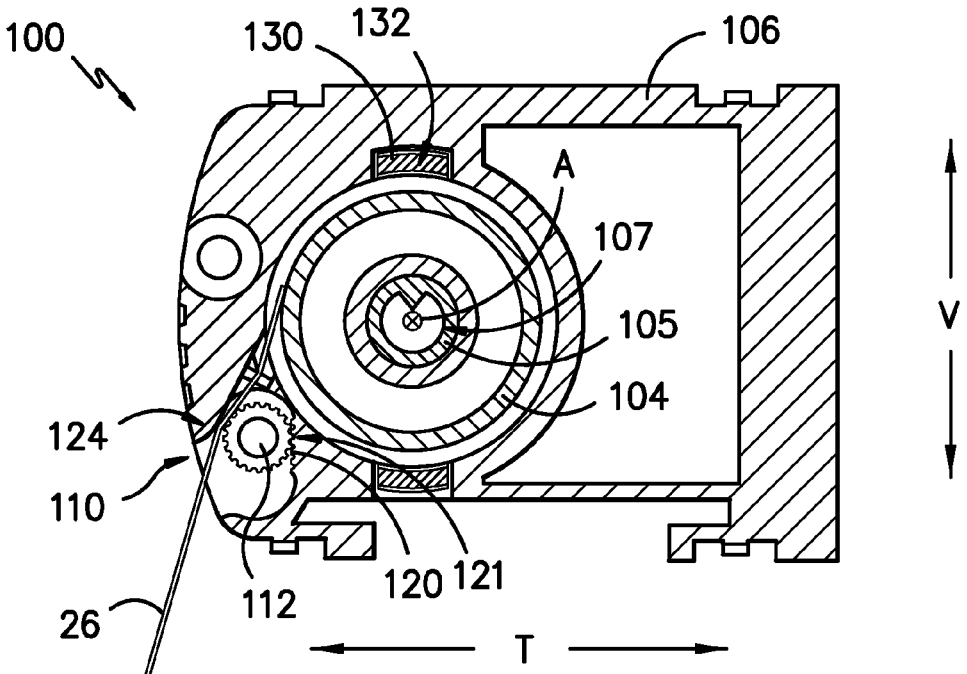
SECTION A–A
FIG. –15–

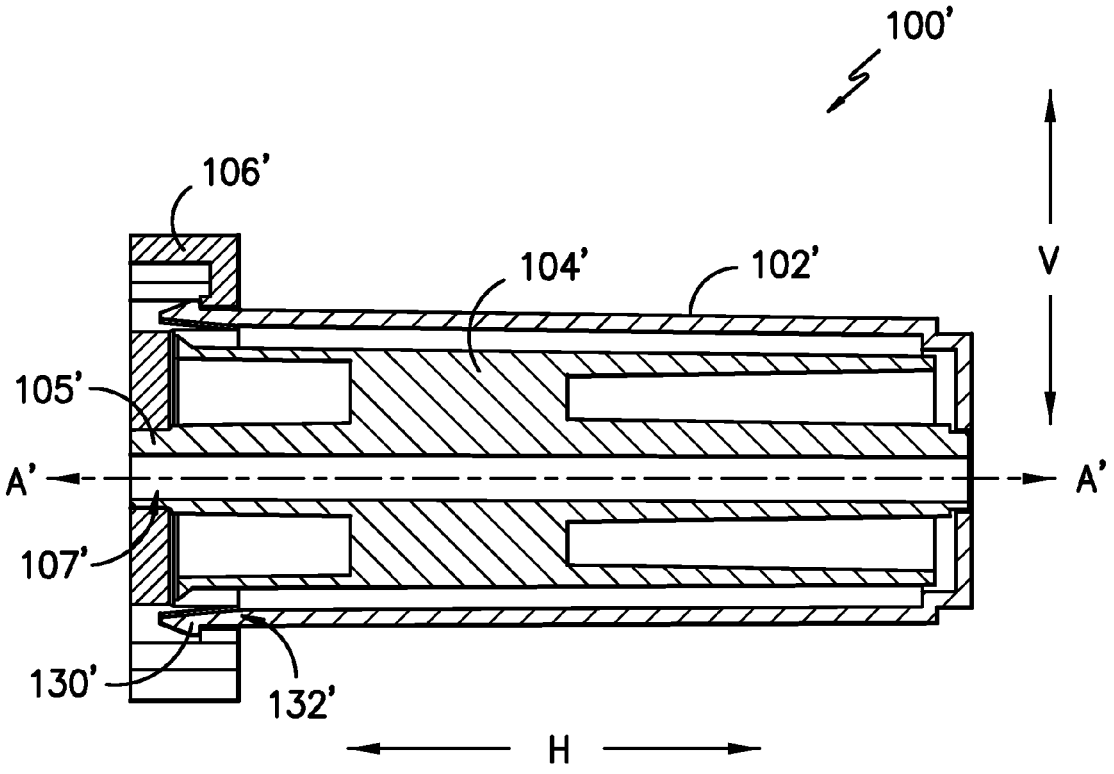
SECTION B–B
*FIG. –23–*

CORD LOCK ASSEMBLY

FIELD OF THE DISCLOSURE

The present subject matter relates generally to a cord lock assembly for retractable shades, blinds, and other coverings.

BACKGROUND OF THE DISCLOSURE

Retractable coverings for architectural openings such as windows, doors, archways and the like, have become commonplace and assume numerous variations for both functional and aesthetic purposes. Such retractable coverings typically include a headrail, in which the working components for the covering are primarily confined, a bottom rail generally extending parallel to the headrail, and some form of shade, which may be fabric or other manipulative structure, interconnecting the headrail and bottom rail. The shade is movable with the bottom rail between an extended and retracted position relative to the headrail. In other words, as the bottom rail is lowered or raised relative to the headrail, the fabric or other material is extended away from the headrail or retracted toward the headrail so it can be accumulated either adjacent to or within the headrail.

Other retractable coverings may further include an intermediate rail positioned between the bottom rail and headrail, with the shade extending between the bottom rail and intermediate rail. Use of an intermediate rail allows a shade assembly to open from a top end down. When so opened, the shade assembly exposes a top end of the architectural opening while still covering a lower end of the architectural opening. Such a construction may be referred to as a "top-down, bottom-up" shade assembly.

Systems for operating such retractable coverings can assume various forms as well. For example, one or more cord lock assemblies may be provided, positioned at a left end and/or right end of the headrail. The cord lock assemblies may each include a pull cord, with the pull cords operatively connected to one or more lift cords that are, in turn, connected to the bottom rail or the intermediate rail. With such a construction, the user may extend or retract the bottom rail and/or the intermediate rail of the shade assembly by pulling out or letting in the corresponding pull cord, Generally, the cord lock assemblies also provide a locking mechanism for the user to hold the bottom rail or intermediate rail of the shade assembly in a desired position.

However, certain problems may exist with the above configuration. For example, current cord lock assemblies may require multiple direction changes for the pull cord to enable it to retract and extend the bottom rail or the intermediate rail. These direction changes may increase the amount of friction and resistance when a user pulls out or lets in the pull cord. Additionally, current cord lock assemblies generally require a user to move the pull cord to the left or right to engage the locking mechanism. Such a requirement may be difficult when, for example, the shade assembly is covering an architectural opening adjacent to a corner in a room or large furniture in the room.

Accordingly, a cord lock assembly that allows for a reduction in the amount of friction and resistance on a pull cord would be useful. Moreover, a cord lock assembly that does not require a user to move the pull cord to the left or right to engage the locking mechanism would also be useful.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 14 provides an outside cross-sectional view of another cord lock assembly in accordance with exemplary aspects of the present disclosure, with the roller in the unlocked position;

FIG. 15 provides an outside cross-sectional view of the exemplary cord lock assembly of FIG. 14 with the roller in the unlocked position;

FIG. 23 provides a front cross-sectional view of the exemplary cord lock assembly of FIG. 16, taken along line B-B of FIG. 21.

DETAILED DESCRIPTION OF THE INVENTION

Figure 1:
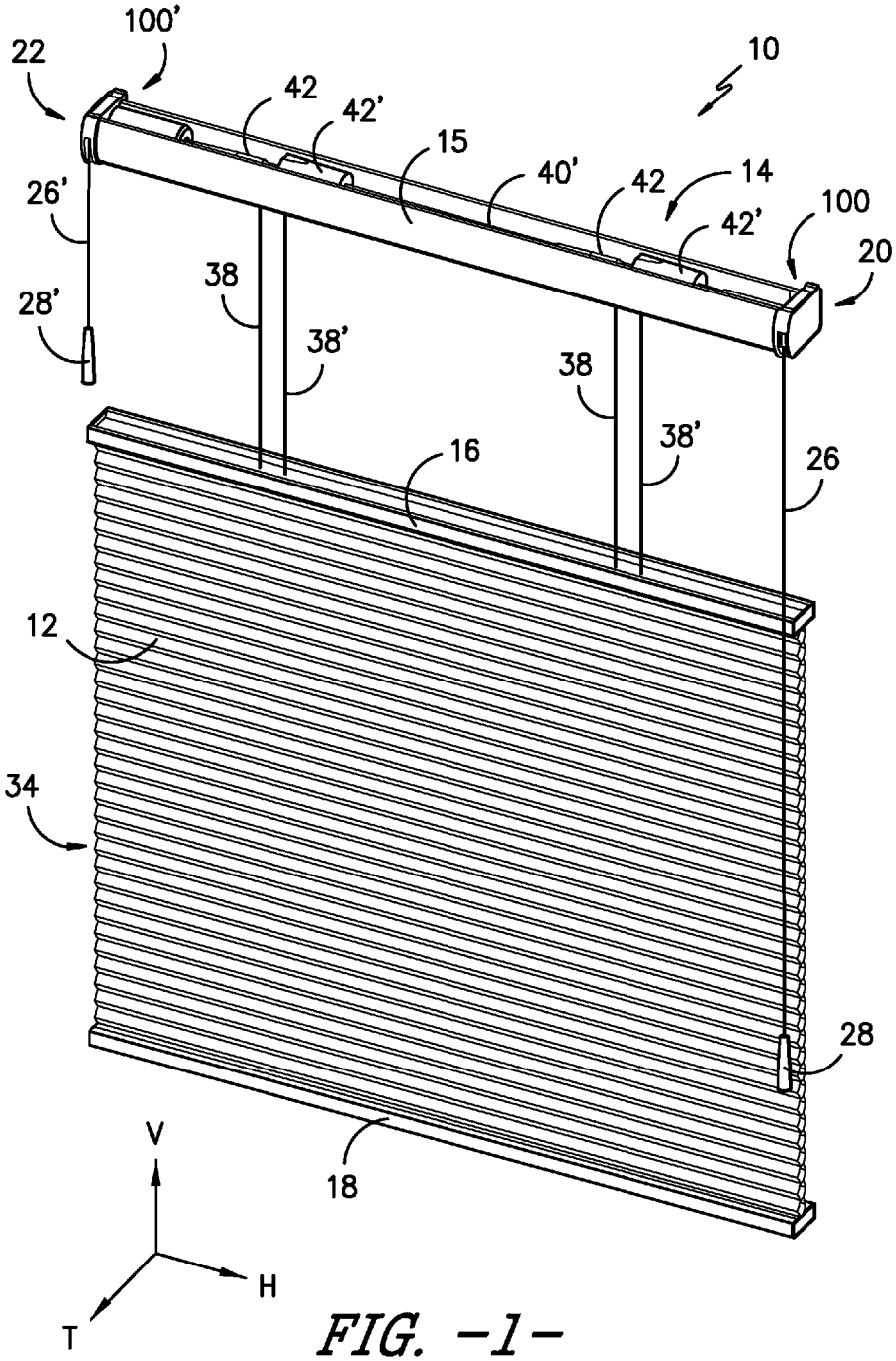
FIG. 1 provides a perspective view of a shade assembly in accordance with exemplary aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a direct drive cord lock assembly for an extendable and retractable shade assembly that may reduce an amount of friction and resistance on a pull cord and allow for a single pull cord to extend or retract a rail in the shade assembly. Accordingly, a cord lock assembly in accordance with certain exemplary embodiments of the present disclosure may allow for a more even lift across an entire rail, provide for enhanced child safety features, provide for a shade assembly with a more aesthetically pleasing, clean, and slick appearance, and avoid the situation with traditional multiple-cord lock assemblies where one cord locks and another cord fails to lock causing a corresponding rail to hang in an uneven manner. Additionally, a cord lock assembly in accordance with certain exemplary embodiment of the present disclosure may allow a user to lock the one or more rails of the shade assembly in place without having to move the pull cord to the left or right relative to the shade assembly and may prevent excess drop of a rail in the shade assembly when locking the cord in place.

Figure 2:
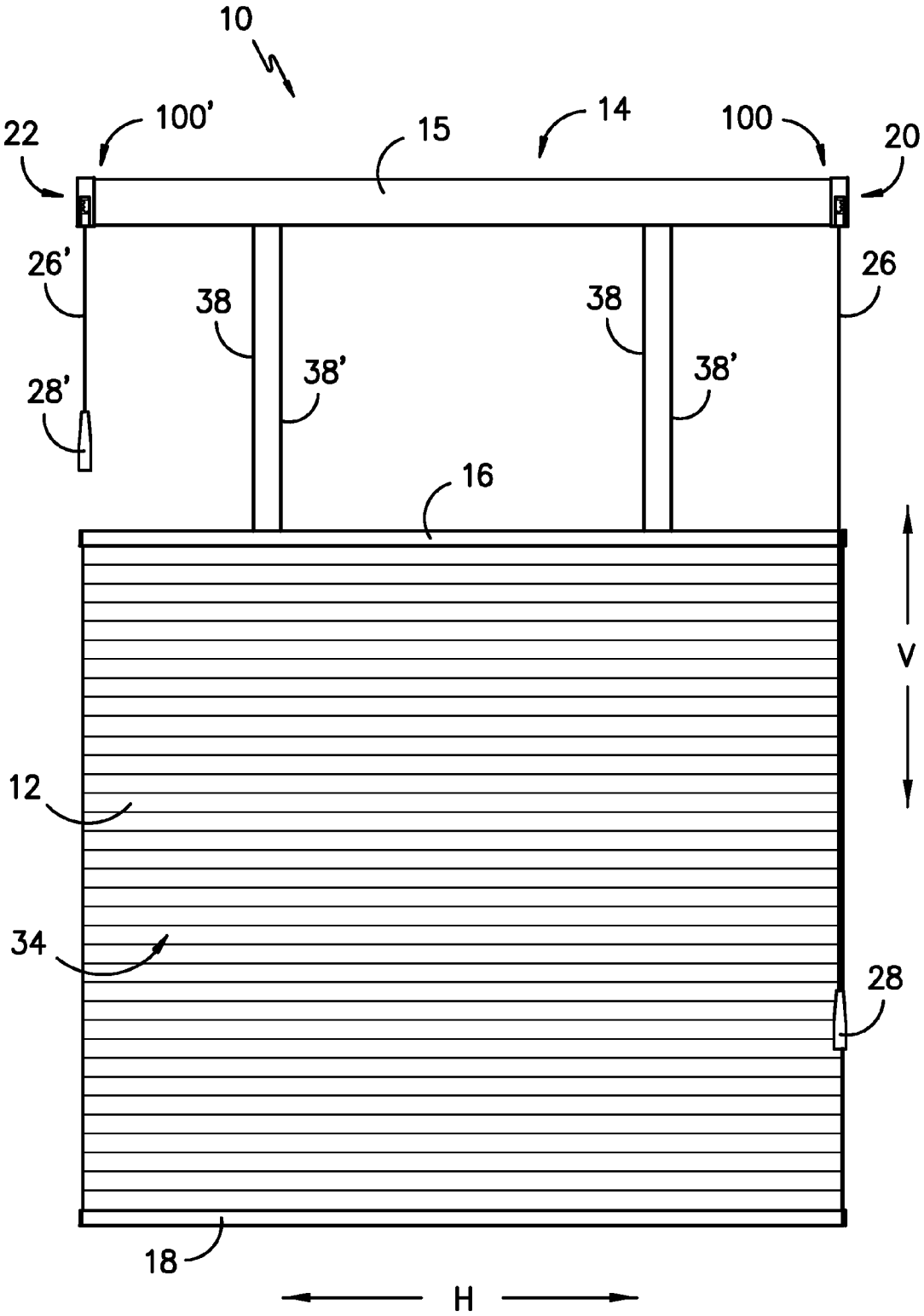
FIG. 2 provides a front view of the exemplary shade assembly of FIG. 1.
Figure 3:
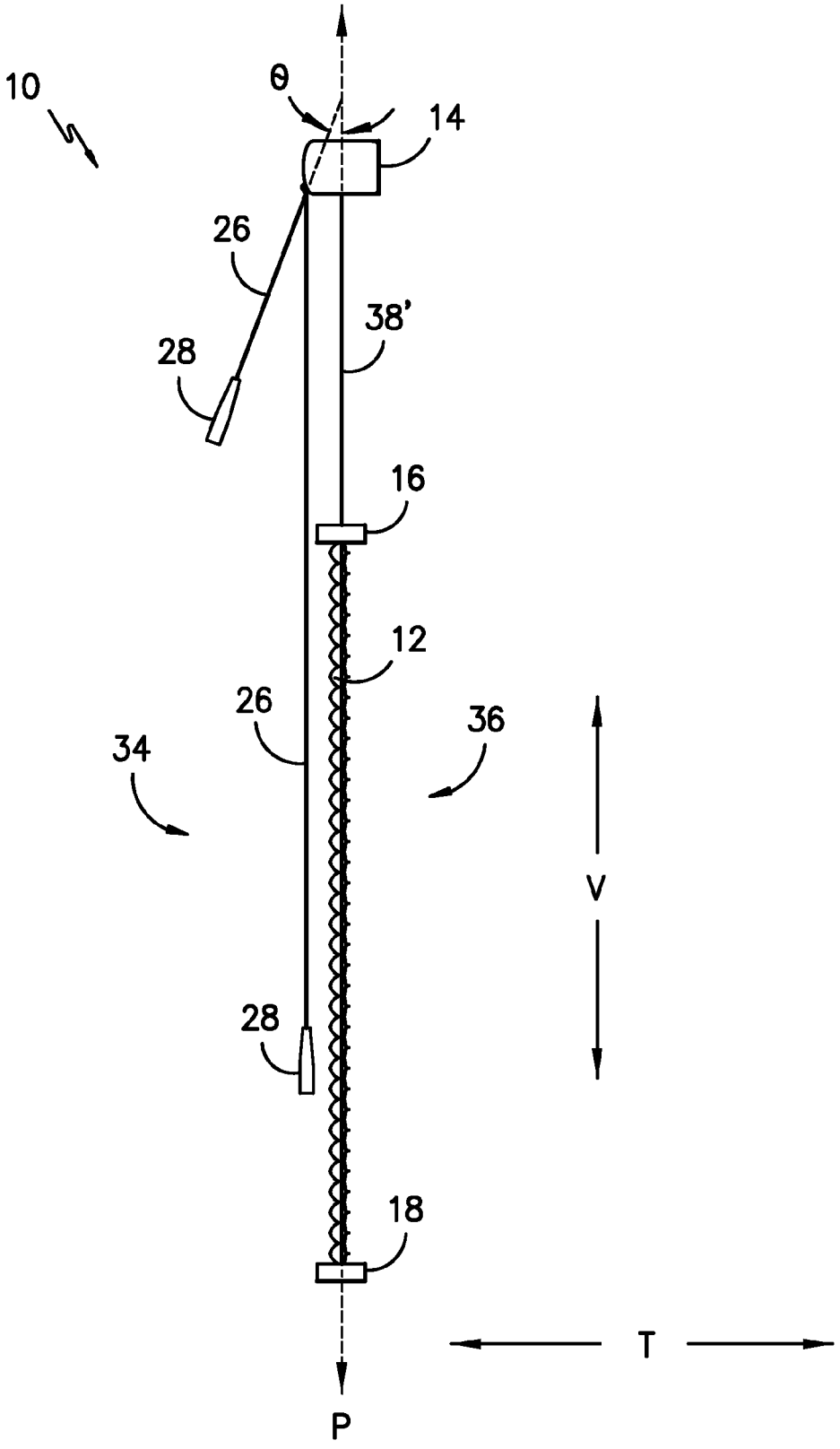
FIG. 3 provides a side view of the exemplary shade assembly of FIG. 1.

With reference now to the FIGS. 1, 2, and 3 provide a perspective view, a front view, and a side view, respectively, of a shade assembly 10 in accordance with an exemplary embodiment of the present disclosure. The exemplary shade assembly 10 of FIGS. 1-3 generally includes a headrail assembly 14, a bottom rail 18, an intermediate rail 16, and a shade material 12. The intermediate rail 16 is positioned between the headrail assembly 14 and bottom rail 18 and the shade material 12 is a cellular shade connected to and extending longitudinally between the intermediate rail 16 and bottom rail 18. The shade assembly 10 defines a front side 34, a rear side 36, and a central plane P between the front and rear sides 34, 36. The central plane P may be defined by a longitudinal direction of the shade material 12 and a latitudinal, or crosswise, direction of the shade material 12. For the exemplary embodiment of FIGS. 1-3, the longitudinal direction of the shade material 12 corresponds to a vertical direction V and the latitudinal, or crosswise, direction of the shade material 12 corresponds to a horizontal direction H (see FIG. 2). The shade assembly 10 further defines a transverse direction T orthogonal to the central plane P (see FIG. 3).

Referring still to FIGS. 1-3, the headrail assembly 14 defines a left end 22 and a right end 20. The left end 22 of the headrail assembly 14 refers generally to the portion of the headrail assembly 14 left of center when facing the front 34 of the shade material 12, while the right end 20 of the headrail assembly 14 refers generally to the portion of the headrail assembly 14 right of center when facing the front 34 of the shade material 12. The headrail assembly 14 may include a pair lifting rods extending through a body 15 of the headrail assembly 14, or more particularly, a lifting rod corresponding to the bottom rail 18 (not shown) and a lifting rod 40' corresponding to the intermediate rail 16. The lifting rods 40' may include one or more spools 42, 42'. The spools 42, 42' may have lift cords 38, 38' wrapped therearound, with the lift cords 38, 38' extending down from a body 15 of the headrail assembly 14 to the bottom rail 18 and/or the intermediate rail 16. Rotating the lifting rods 42' in a first direction may let out the lift cords 38, 38' and lower a corresponding rail, while rotating the lifting rods 42' in a second and opposite direction may take in the lift cords 38, 38' and raise the corresponding rail.

For the exemplary embodiment of FIGS. 1-3, the headrail assembly 14 additionally includes a pair of cord lock assemblies 100, 100' to allow a user to control the bottom rail 18 and the intermediate rail 16. Each exemplary cord lock assembly 100, 100' may be attached to and configured to rotate one or more of the lifting rods 40'. As shown, each exemplary cord lock assembly 100, 100' includes at least a portion positioned in the body 15 of the headrail assembly 14 and may allow a user to extend, retract, or lock in place one of the bottom rail 18 or the intermediate rail 16 using a corresponding pull cord 26, 26' and tassel 28, 28'. An angle θ is defined between the pull cords 26, 26' and the central plane P (see FIG. 3).

For the exemplary shade assembly of FIGS. 1-3, the headrail assembly 14 includes a cord lock assembly 100 on the right side 20 to control the bottom rail 18 and a cord lock assembly 100' on the left side 22 to control the intermediate rail 16. Accordingly, a user may retract or extend the bottom rail 18 by moving the pull cord. 26 of the cord lock assembly 100 positioned on the right side 20 outwardly or inwardly, respectively, relative to the body 15 of the headrail assembly 14. Similarly, a user may retract or extend the intermediate rail 16 by moving the pull cord 26' of the cord lock assembly 100' on the left side 22 outwardly or inwardly, respectively, relative to the body 15 of the headrail assembly 14. The weight of the bottom or intermediate rail 18, 16 may allow the user to move the pull cord 26, 26' inwardly relative to the body 15 of the headrail assembly 14.

The exemplary shade assembly 10 of FIGS. 1-3 may open to reveal the architectural opening from a top end by extending the intermediate rail. 16, or from a bottom end by retracting the bottom rail 18. Accordingly, the shade assembly 10 may be referred to as a "top-down, bottom-up" shade assembly.

It should be appreciated, however, that the exemplary shade assembly 10 of FIGS. 1-3 is provided by way of example only. In other exemplary embodiments of the present disclosure, the shade assembly 10 may have any other suitable configuration. For example, the cord lock assemblies 100, 100' may be switched such that the cord lock assembly 100 configured to control the bottom rail 18 is positioned on the left end 22 of the headrail assembly 14, and the cord lock assembly 100' configured to control the intermediate rail 16 is positioned on the right end 20 of the headrail assembly 14. Alternatively, in other exemplary embodiments, the shade assembly 10 may not be a top-down, bottom-up shade assembly, and as such, may not include the intermediate rail 16, or a corresponding cord lock assembly 100' at the left side 22 of the headrail assembly 14. In such an exemplary, embodiment, the shade material 12 may be connected directly to the headrail assembly 14, and the cord lock assembly 100 corresponding to the bottom rail 18 may be positioned on the right end 20 of the headrail assembly 14, the left end 22 of the headrail, or anywhere in between. Alternatively still, in other exemplary embodiments, the rods 40' may be linked together, such that the bottom rail 18 and intermediate rail 16 are operated by a single cord lock assembly 100. For example, the rod linked to the bottom rail 18 may be geared to rotate twice as much as the rod 40' linked to the intermediate rail 16. However, in other exemplary embodiments, any other suitable linkage may be provided within the body 15 of the headrail assembly 14.

It should also be appreciated that in still other exemplary embodiments, the shade material 12 may not be a cellular shade, and instead may have any other suitable shade configuration for, e.g., blocking light, providing privacy, increasing the aesthetic appeal of a room and/or allowing a desired amount of light into a room. For example, in other exemplary embodiments, the shade material 12 may be horizontal blinds, roman shades, roller or rolled shades, or any other suitable shade or blind. For example, when the shade material 12 is a roller shade, the exemplary shade assembly 10 may not include a bottom rail or an intermediate rail, and the headrail may simply be a roller with the rolled shade wrapped therearound. In such an embodiment, the cord lock assembly 100 may be attached to a mount and a first end of the headrail and the second end of the headrail may also be attached to a mount such that the roller shade assembly may be positioned in an architectural opening. Moreover, in any of the above embodiments, the shade material 12 may by comprised of any suitable fabric or material, such as a sheer, laminate, wood, faux wood, and/or woven material.

Figure 4:
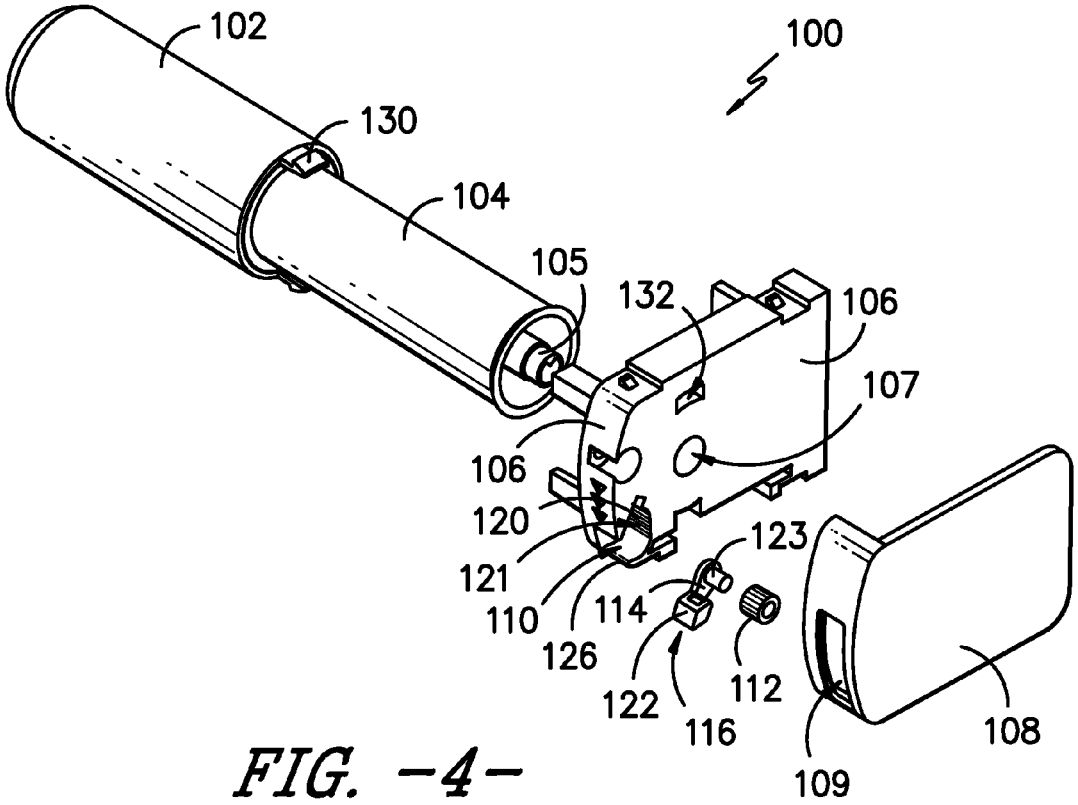
FIG. 4 provides an exploded perspective view of a cord lock assembly in accordance with exemplary aspects of the present disclosure.
Figure 5:
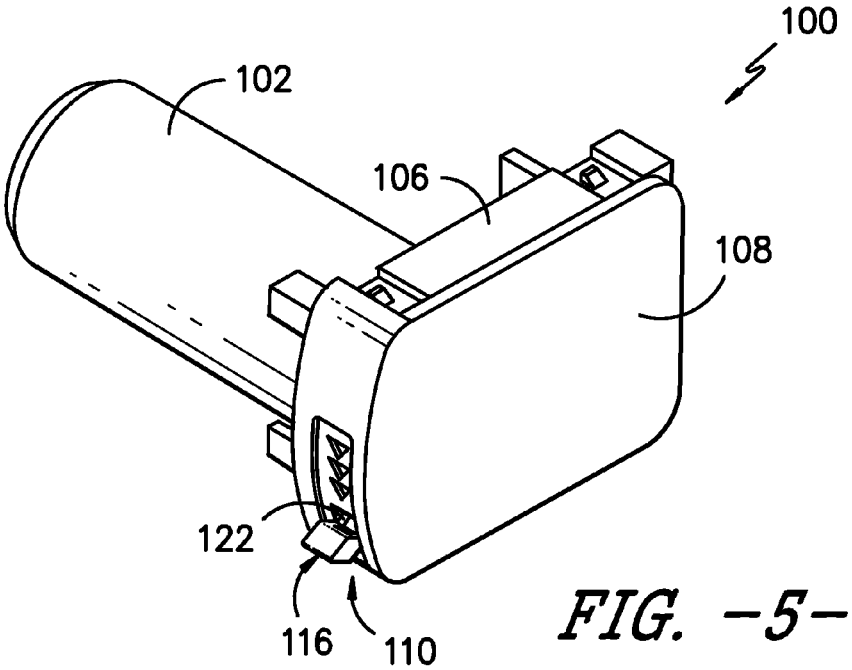
FIG. 5 provides an outside perspective view of the exemplary cord lock assembly of FIG. 4.
Figure 6:
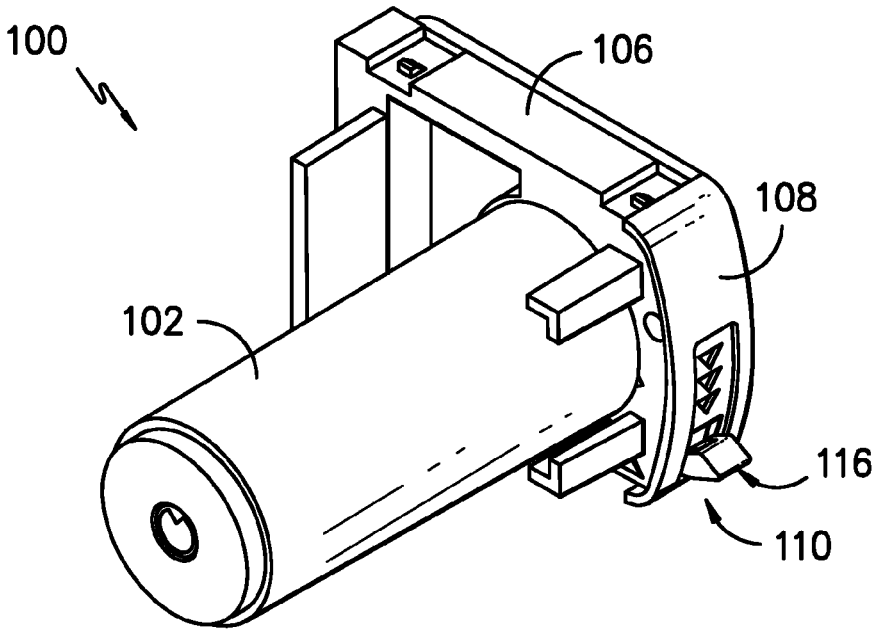
FIG. 6 provides an inside perspective view of the exemplary cord lock assembly of FIG. 4.
Figure 7:
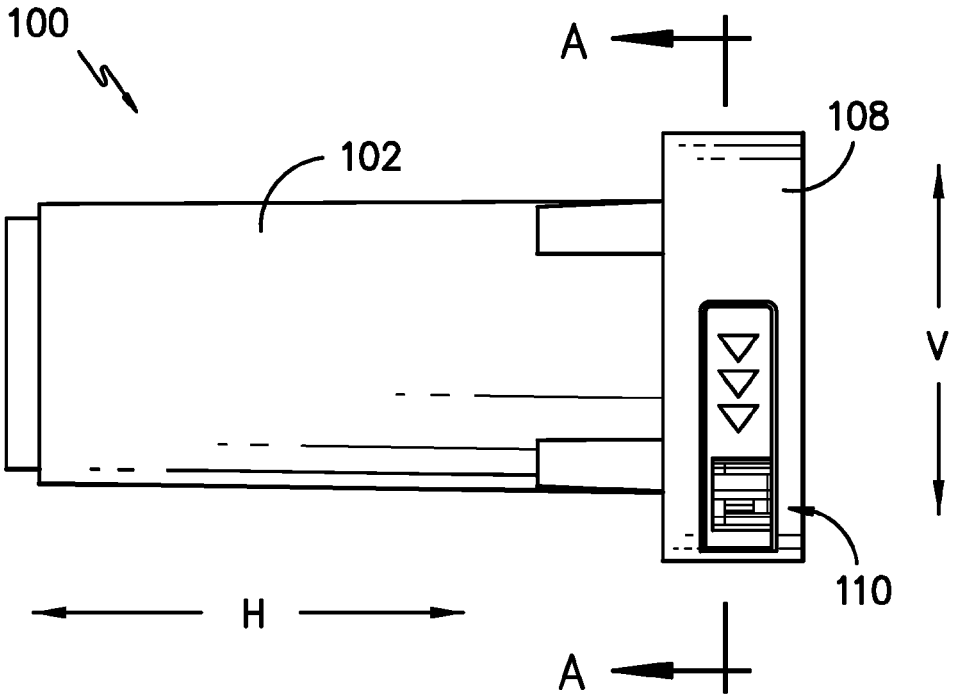
FIG. 7 provides a front view of the exemplary cord lock assembly of FIG. 4.
Figure 8:
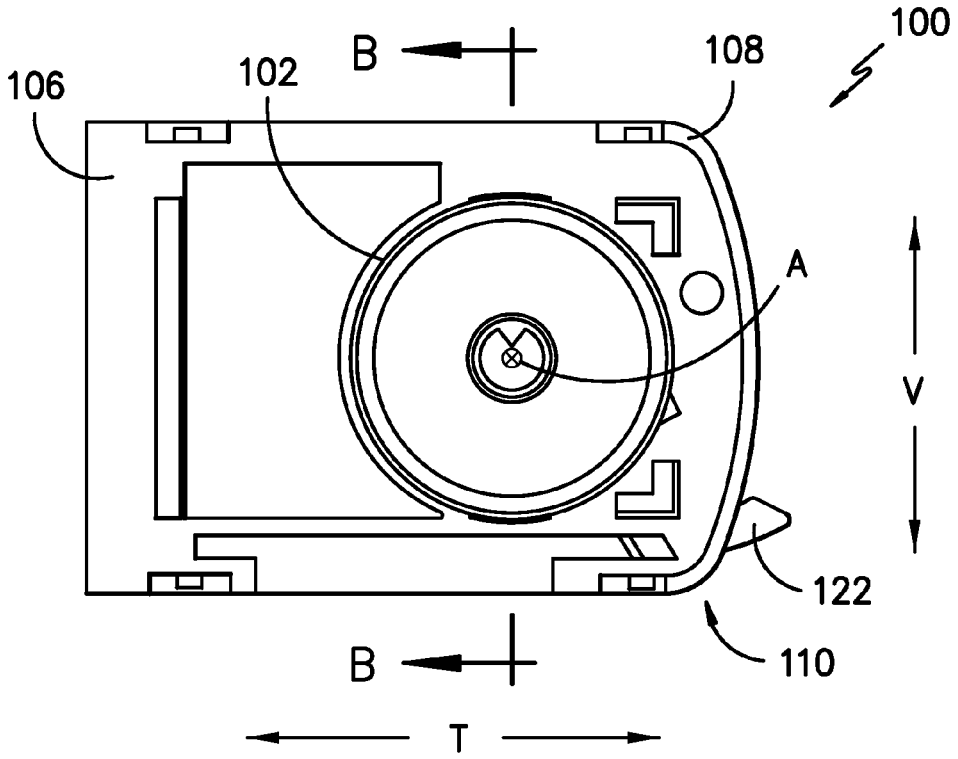
FIG. 8 provides an inside view of the exemplary cord lock assembly of FIG. 4.
Figure 9:
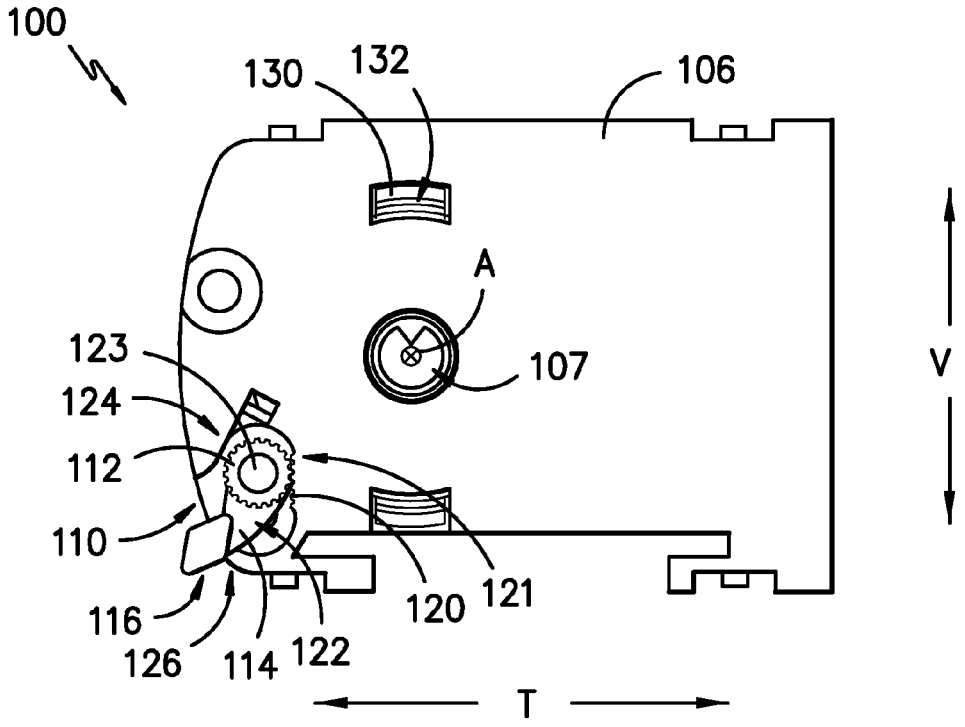
FIG. 9 provides an outside view of the exemplary cord lock assembly of FIG. 4 with the endcap removed and the roller in a locked position.
Figure 10:
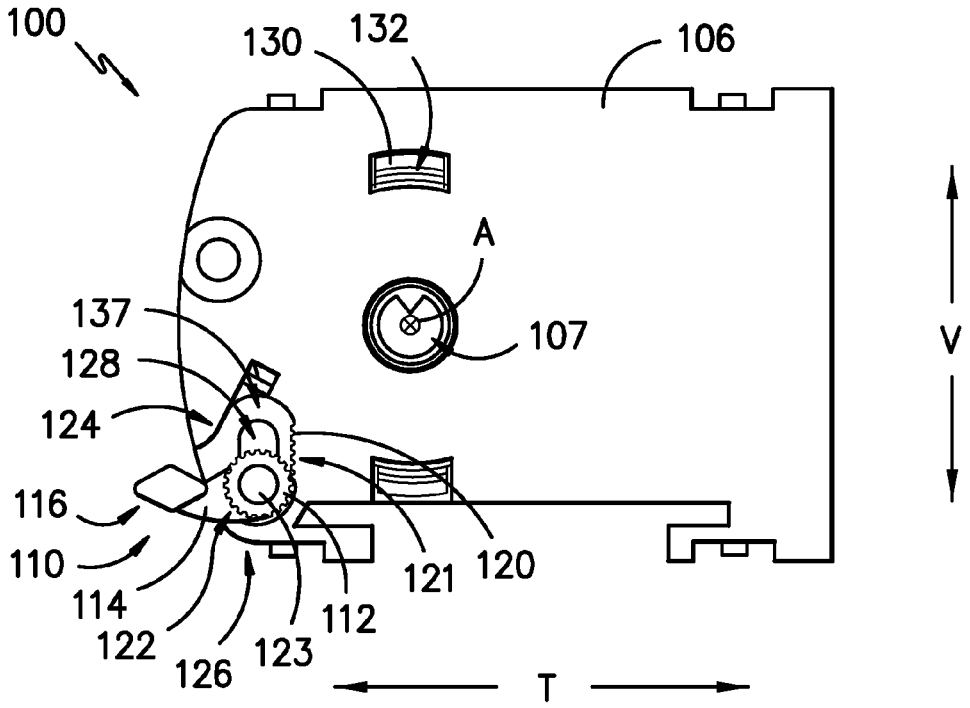
FIG. 10 provides an outside view of the exemplary cord lock assembly of FIG. 4 with the endcap removed and the roller in an unlocked position.
Figure 11:
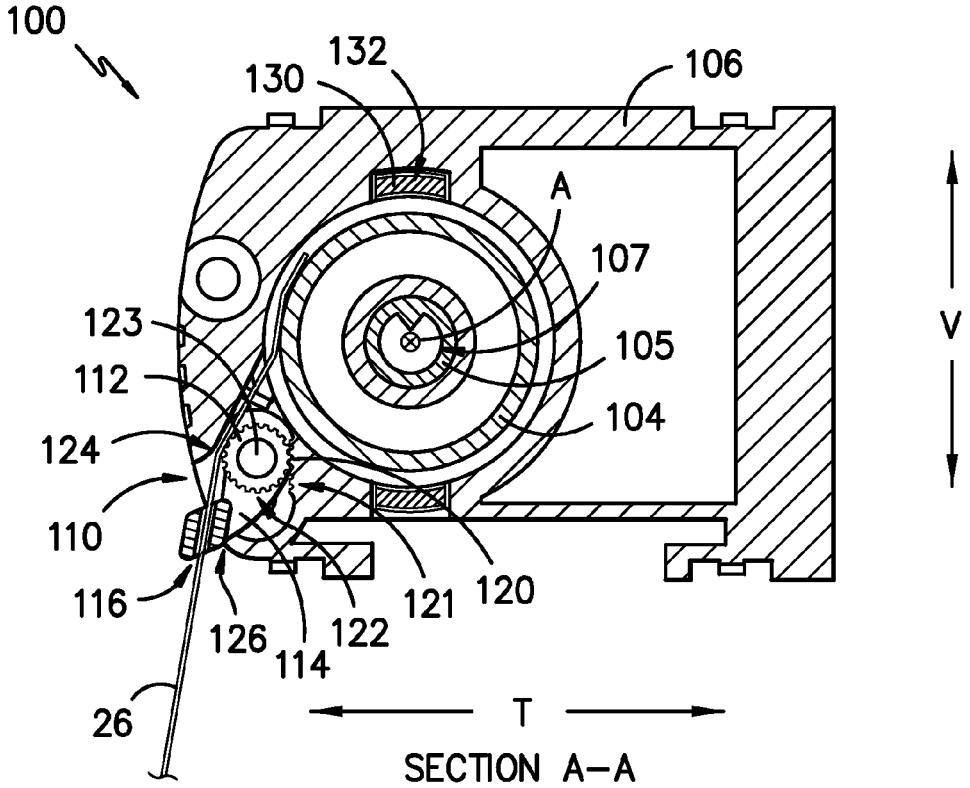
FIG. 11 provides an outside cross-sectional view of the exemplary cord lock assembly of FIG. 4, taken along line A-A of FIG. 7, with the roller in the locked position.
Figure 12:
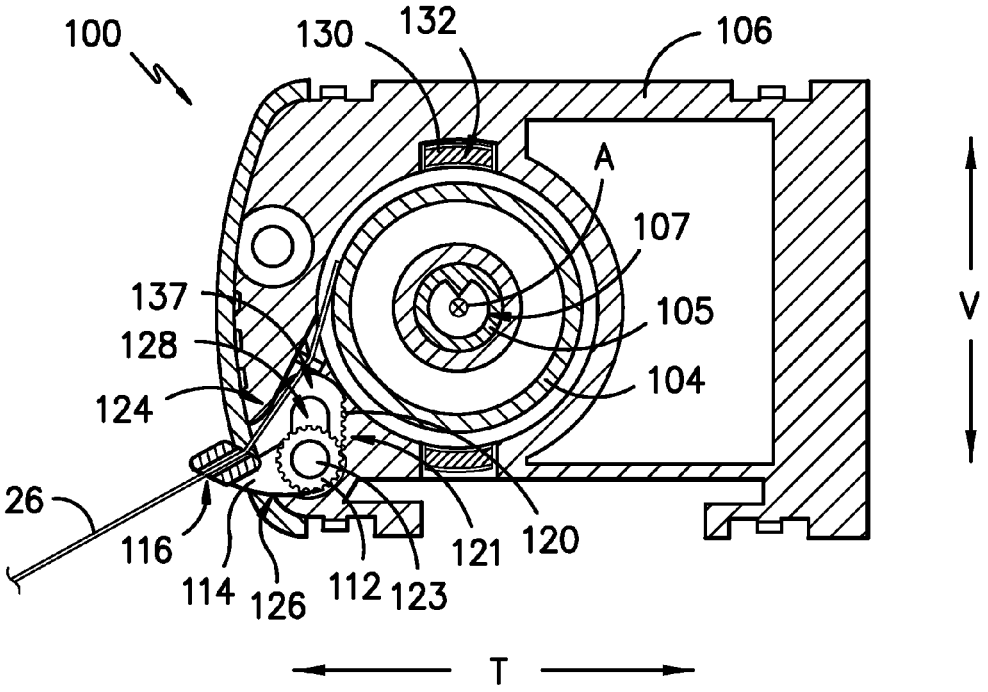
FIG. 12 provides an outside cross-sectional view of the exemplary cord lock assembly of FIG. 4, taken along line A-A of FIG. 7, with the roller in the unlocked position.
Figure 13:
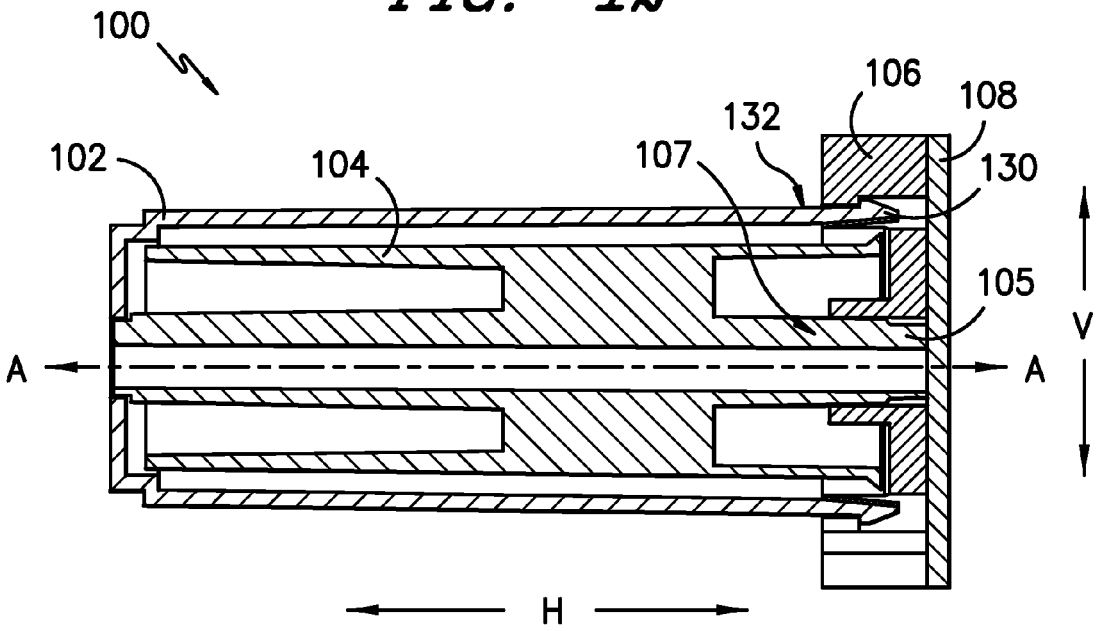
FIG. 13 provides a front cross-sectional view of the exemplary cord lock assembly of FIG. 4, taken along line B-B of FIG. 8.

Referring now generally to FIGS. 4 through 13, various views of an exemplary cord lock assembly 100 are provided. Specifically. FIG. 4 provides an exploded perspective view of an exemplary cord lock assembly 100. FIGS. 5 and 6 provide perspective views of the exemplary cord lock assembly 100 of FIG. 4-FIG. 5 provides an outside perspective view and FIG. 6 provides an inside perspective view. Additionally. FIG. 7 provides a front view of the exemplary cord lock assembly 100 of FIG. 4 and FIG. 8 provides an inside view of the exemplary cord lock assembly 100 of FIG. 4. Two outside views of the exemplary cord lock assembly 100 of FIG. 4 (with the endcap 108 removed) are provided in FIGS. 9 and 10. More particularly. FIG. 9 shows the cord lock assembly 100 in a locked position, while FIG. 10 shows the cord lock assembly 100 in an unlocked position. Similarly, two outside side cross-sectional views of the exemplary cord lock assembly 100 of FIG. 4, taken along line A-A of FIG. 7, are provided in FIGS. 11 and 12. As with FIGS. 9 and 10. FIG. 11 shows the cord lock assembly 100 in the locked position, while FIG. 12 shows the cord lock assembly 100 in the unlocked position. Additionally, FIG. 13 provides a front cross-sectional view of the exemplary cord lock assembly 100 of FIG. 4, taken along line B-B of FIG. 8.

In certain exemplary embodiments, the cord lock assembly 100 of FIGS. 4 through 13 may operate the bottom rail 18 of the shade assembly 10 of FIGS. 1-3 and may be positioned on the right side 20 of the headrail assembly 14 depicted in FIGS. 1-3.

Referring specifically to FIG. 4, an exploded perspective view of the exemplary cord lock assembly 100 is provided. The exemplary cord lock assembly 100 generally includes an spool 104 rotatably connected to a housing 106. More particularly, the spool 104 defines a central axis A (see FIG. 13) and an inner cylindrical member 105 extending along the central axis A of the spool 104. Moreover, the housing 106 defines an opening 107 configured to receive the cylindrical member 105 of the spool 104. When the cylindrical member 105 of the spool 104 is positioned in the opening 107 of the housing 106, the spool 104 may rotate about its axis A relative to the housing 106. Additionally, as may be more clearly seen in, for example, FIG. 13, the spool 104 is positioned at least partially within the housing 106, such that the housing 106 extends around at least a portion of the spool 104, such as around a base of the spool 104. Such a configuration may assist is allowing the pull cord 26 to wrap appropriately around the spool 104.

A spool cover 102 is also provided over at least a portion of the spool 104 and is releasably connected to the housing 106. More particularly, for the exemplary embodiment of FIG. 4, the spool cover 102 includes a pair of opposing hooks 130 that fit into a corresponding pair of slots 132 in the housing 106 to hold the spool cover 102 in place. Such a construction may allow the spool cover 102 to hold the spool 104 in position adjacent to the housing 106, while still allowing the spool 104 to rotate about its axis A relative to the housing 106 and the spool cover 102. In certain exemplary embodiments, the axis A of the spool 104 may be parallel to the latitudinal or crosswise direction defined by the shade assembly 10 in FIGS. 1-3. An endcap 108 is also provided to cover an outside end of the housing 106.

It should be appreciated, however, that the spool 104, spool cover 102, housing 106, and endcap 108 are provided by way of example only. In other exemplary embodiments, for example, the spool 104 may be rotatably connected to the housing 106 in any other suitable manner, or alternatively, the spool 104 and housing 106 may not be connected. Additionally, or alternatively, the spool cover 102 may be attached to the housing in any suitable manner, or the cord lock assembly 100 may not include a spool cover 102 altogether. Similarly, in other exemplary embodiments, any other appropriate endcap 108, if any, may be provided.

Referring still to FIG. 4, the exemplary cord lock assembly 100 additionally includes a pull cord channel 110 defined by the housing 106 and a corresponding slot 109 in the endcap 108. The pull cord channel 110 extends through the housing 106 to an edge of the spool 104 and includes a bottom ledge 126. The bottom ledge 126 extends underneath the pull cord channel 110 generally in a transverse direction T away from the central plane P of the shade assembly. As discussed below with reference to FIGS. 11 and 12, the pull cord 26 may extend directly through the pull cord channel 110 to the spool 104 and wrap around the spool 104. Such a configuration may reduce the amount of friction and resistance on the pull cord 26 in the cord lock assembly 100 as the contact surfaces leading the pull cord 26 to the spool 104 are minimized.

The exemplary cord lock assembly of FIG. 4 further includes a cam 122 positioned at least partially in the pull cord channel 110, the cam 122 defining a pin 123 at a first end, a pull cord slot 116 at a second end, and a rocker arm 114 extending therebetween. Additionally, a roller 112 is rotatably positioned on the pin 123 of the cam 122.

Operation of the cam 122 and roller 112 of the exemplary cord lock assembly 100 of FIG. 4 may be more clearly seen in the side cross-sectional views of FIGS. 11 and 12. As shown, the pin 123 at the first end of the cam 122, along with the roller 112 rotatably positioned thereon, may move along a length of the pull cord channel 110, which for the exemplary embodiment of FIGS. 11 and 12 corresponds to the vertical direction V. The movement of the first end of the cam 122 may be guided by a slot 128 in the pull cord channel 110. For example, the first end of the cam 122 may include a guide member (not shown) slidingly attached to the slot 128 to ensure the second end of the cam 122 moves in the desired directions. The guide member may have any suitable shape. For example, the guide member may be a pin, a "I"-shaped extension, or a nailhead shaped extension. Alternatively, however, in still other exemplary embodiments, the cam 122 may not include a guide member.

As discussed above, FIG. 11 depicts the roller 112 in the locked position, and FIG. 12 depicts the roller 112 in the unlocked position. More particularly, when in the locked position, the area between the roller 112 and an upper wall 124 in the pull cord channel 110 is minimized such that the pull cord 26 is pinched between the roller 112 and the upper wall 124 (see FIG. 11). Such functionality is provided at least in part due to a gap 137 in the pull cord channel 110 between the upper wall 124 and the rear wall 121 having a width along the transverse direction T less than an effective width of the roller wheel 112 and pull cord 26. By contrast, when in the unlocked position, the roller 112 is positioned vertically lower in the pull cord channel 110, or away from the upper wall 124 in the pull cord channel 110 (see FIG. 12). Accordingly, when in the unlocked position, the pull cord may be able to pass freely through the pub cord channel 110 without being stopped by the roller 112 and upper wall 124.

For the exemplary cord lock assembly 100 of FIGS. 11 and 12, the roller 112 may be moved to the locked position by decreasing the angle θ defined by the pull cord 26 and the central plane P (see FIG. 3) to less than about 30 degrees. It should be appreciated, however, that in other exemplary embodiments, the roller 112 may instead be moved to the locked position by decreasing the angle to an angle less than about 60 degrees, less than about 45 degree, or, less than about 15 degrees. Moreover, it should be appreciated that the ranges hereby provided are by way of example only, and in other exemplary embodiments, the roller 112 may be moved to a locked position when the angle θ is decreased to any suitable angle.

Referring still to FIGS. 11 and 12, by decreasing the angle θ, the pull cord 26—due to its placement in the pull cord slot 116 at the second end of the cam 122—may move the second end of the cam 122 in a downward direction and in a direction towards the central plane P of the shade material 12. The rocker arm 114 may then slide inward towards the central plane P of the shade material 12, and vertically upward. Thus, the pin 123 and roller 114 may be moved in a vertically upward direction within the pull cord channel 110. Such a reaction may be due at least in part to the interaction of the rocker arm 114 with the bottom ledge 126 of the pull cord channel 110. For example, the rocker arm 114 may cause the pin 123 at, the first end of the cam 122, and the roller 112 rotatably positioned thereon, to move in a vertically upward direction when the second end of the cam 122 is moved in a vertically downward direction or in a direction towards the central plane P of the shade material 12.

For the exemplary embodiment of FIGS. 11 and 12, the rocker arm 114 has a curved shape to enhance the movement of the first end of the cam 122 relative to the second end of the earn 122. However, in other exemplary embodiments, the rocker arm 114 may have any other suitable shape. Additionally, modifying the shape of the rocker arm 114 may affect the angle θ necessary to move the roller 112 into the locked position. Further, although for the exemplary embodiment of FIGS. 11 and 12, the rocker arm 114 is configured to interact with the bottom ledge 126 of the pull cord channel 110, in other exemplary embodiments, the rocker arm 114 may instead, or in addition, interact with for example, the slot 109 in the endcap 108.

Once the roller 112 is in the locked position, the weight of the rail may keep tension on the pull cord 26, and hold the roller 112 in the locked position. As may be seen in FIGS. 11 and 12, the pull cord channel 110 may narrow towards a top end to allow the pull cord 26 to be pinched between the roller 112 and the upper wall 124 of the pull cord channel 110 when the roller 112 is in the locked position. For the exemplary embodiment of FIGS. 11 and 12, the roller 112 is a serrated roller 112 and thus defines a plurality of circumferential ridges, the circumferential ridges corresponding to a plurality of ridges 120 defined by the rear wall 121 of the pull cord channel 110. The circumferential ridges of the roller 112 are configured to interact with the plurality of ridges 120 defined by the rear wall 121 of the pull cord channel 110 such that rotating the roller 112 moves the roller 112 along the rear wall of the pull cord channel 110. Such a construction may improve the locking function of the roller 112 by minimizing any slippage between the rear wall 121 and the roller 112, between the roller 112 and the pull cord 26, and between the pull cord 26 and the upper wall 124.

It should be appreciated, however, that in other exemplary embodiments of the present disclosure, the roller 112 and rear wall 121 may have any other suitable construction. For example, in other exemplary embodiments, only one of the roller 112 or rear wall 121 may have ridges, or alternatively, one or both of the roller 112 and the rear wall 121 may include a "gritty" surface or neural surface to increase traction therebetween. The gritty surface may be, for example, a sandpaper-type surface, and the neural surface may be, for example, a diamond pattern.

Referring still to the exemplary cord lock assembly 100 of FIGS. 11 and 12, the roller 112 may, by contrast, be moved to an unlocked position (see FIG. 12) by increasing the angle θ defined by the pull cord 26 and the central plane P (see FIG. 3) to an angle greater than about 30 degrees and by moving the pull cord 26 outwardly relative to the body 15 of the headrail assembly 14. It should be appreciated, however, that in other exemplary embodiments, the roller 112 may instead be moved to the unlocked position by increasing the angle θ to an angle greater than about 15 degrees, greater than about 45 degrees, or greater than about 60 degrees. Moreover, it should be appreciated that the ranges hereby provided are by way of example only, and in other exemplary embodiments, the roller 112 may be moved to an unlocked position when the angle θ is increased to any suitable angle.

Additionally, by moving the pull cord 26 outwardly, the pull cord 26 may interact with the roller 112, rotating the roller 112 and moving it vertically downward within the pull cord channel 110. More particularly, for the exemplary embodiment of FIGS. 11 and 12, the roller 112 may rotate counter-clockwise to move from the locked position into the unlocked position. Once the roller 112 has moved far enough down and away from the upper wall 124 of the pull cord channel 110 such that it no longer presses the pull cord 26 against the upper wall 124, gravity may cause the roller 112 to drop vertically downward into the unlocked position.

A cord lock assembly 100 having such a configuration may have many benefits. For example, such a cord lock assembly may minimize the amount the rail and shade material 12 drops when a user is placing the roller 112 in the locked position and releases the pull cord 26. Additionally, such a configuration may allow a user to move the roller 112 of the cord lock assembly 100 into a locked position by moving the pull cord 26 in a transverse direction T towards the central plane P of the shade material 12 and inwardly relative to the body 15 of the headrail assembly 14, or to move the roller 112 into an unlocked position by moving the pull cord 26 in a transverse direction T away from the central plane P and outwardly relative to the body 15 of the headrail assembly 14. This may allow for greater ease of operation when, for example, the shade assembly is positioned in an architectural opening adjacent to a wall or positioned adjacent to a large piece of furniture.

Moreover, when the roller 112 is in the unlocked position, such as is shown in the cross-sectional view of FIG. 12, movement of the pull cord 26 through the pull cord channel 110 may be uninhibited and the pull cord 26 may extend directly to the spool 104. Such a configuration may reduce the amount of friction and resistance in the direct drive cord lock assembly 100 by reducing the amount of turns the pull cord 26 needs to make within the cord lock assembly 100, making it easier for a user to, e.g., extend or retract the bottom rail 18 and/or intermediate rail 16 relative to the body 15 of the headrail assembly 14. More particularly, such a configuration may reduce the amount of friction and resistance created on the pull cord 26 when moving the pull cord 26 inwardly and/or outwardly relative to the body 15 of the headrail assembly 14. The above benefit may be further enhanced by using a single pull cord. 26 in the cord lock assembly 100, which is possible due to the unique construction of the exemplary cord lock assembly 100.

It should be appreciated, however, that exemplary cord lock assembly 100 of FIGS. 4 through 13 is provided by way of example only, and in other exemplary embodiments, the cord lock assembly 100 may have any other suitable configuration. For example, although the pull cord channel 110 of the exemplary cord lock assembly 100 of FIGS. 4 through 13 is oriented generally in the vertical direction V, in other exemplary embodiments, the pull cord channel 110 may be oriented at an angle relative to the vertical direction V. In such an exemplary embodiment, the minimum angle θ of the pull cord 26 required to move the roller 112 into an unlocked position may be increased or decreased, and similarly, the minimum angle θ of the pull cord required to move the roller into a locked position may be increased or decreased. Additionally, in other exemplary embodiments, the cord lock assembly 100 may not require and may not include the bottom ledge 126, or alternatively, the bottom ledge 126 may be any other suitable shape or have any other suitable construction.

It should also be appreciated that in still other exemplary embodiments of the present disclosure, the pull cord channel 110 may be rotated 90 degrees about the vertical direction V within the cord lock assembly 100, such that the roller 112 is moved between the locked and unlocked position by moving the pull cord 26 from side to side along the horizontal direction H. In such an exemplary embodiment, the angle θ may instead be defined between the pull cord 26 and a transverse plane defined by the vertical direction V and the transverse direction T.

Another exemplary embodiment of the cord lock assembly 100 is provided in FIGS. 14 and 15. More particularly, FIG. 14 provides a cross-sectional view of another exemplary cord lock assembly 100 in an unlocked position, and FIG. 15 provides a cross-sectional view of the cord lock assembly 100 of FIG. 14 in a locked position.

The exemplary cord lock assembly. 100 of FIGS. 14 and 15 is constructed similarly to the exemplary cord lock assembly 100 of FIG. 4. By contrast, however, in the exemplary cord lock assembly 100 of FIGS. 14 and 15, the assembly 100 does not include a cam 122. Instead, just the roller 112 is positioned in the pull cord channel 110 defined by the housing 106. Regardless, however, operation of the cord lock assembly 100 of FIGS. 14 and 15 is similar to the operation of the cord loch assembly 100 of FIG. 4. The only distinction being that a user may move the roller 112 to a locked position by moving the pull cord 26 inwardly relative to the body 15 of the headrail assembly 14 (with the angle θ reduced, as discussed above) such that the pull cord 26 interacts with the roller 112 and rotates the roller 112 as the pull cord 26 is moved inwardly. The roller 112 may, in turn, interact with the rear wall 121 of the pull cord channel 110 such that the roller 112 is moved up, or "walked-up," the rear wall 121 of the pull cord channel 110 and increases the pressure on the pull cord 26 positioned between the roller 112 and the upper wall 124 of the pull cord channel 110. For the exemplary embodiment of FIGS. 14 and 15, the roller 112 rotates in a clockwise direction (when viewed from the outside view of FIGS. 14 and 15) when moved to the locked position. Once in the locked position, the weight of the rail may keep tension on the pull cord 26, and hold the roller 112 in the locked position.

In other exemplary embodiments, however, the pull cord channel 110 of the exemplary cord lock assembly 100 of FIG. 14 may further include a roller slot and the roller may include a guide member configured to interact with the roller slot (similar to the cam slot 128 depicted in FIGS. 11 and 12). In such an embodiment, the roller slot may ensure the roller moves within the pull cord channel 110 in the desired directions.

Figure 16:
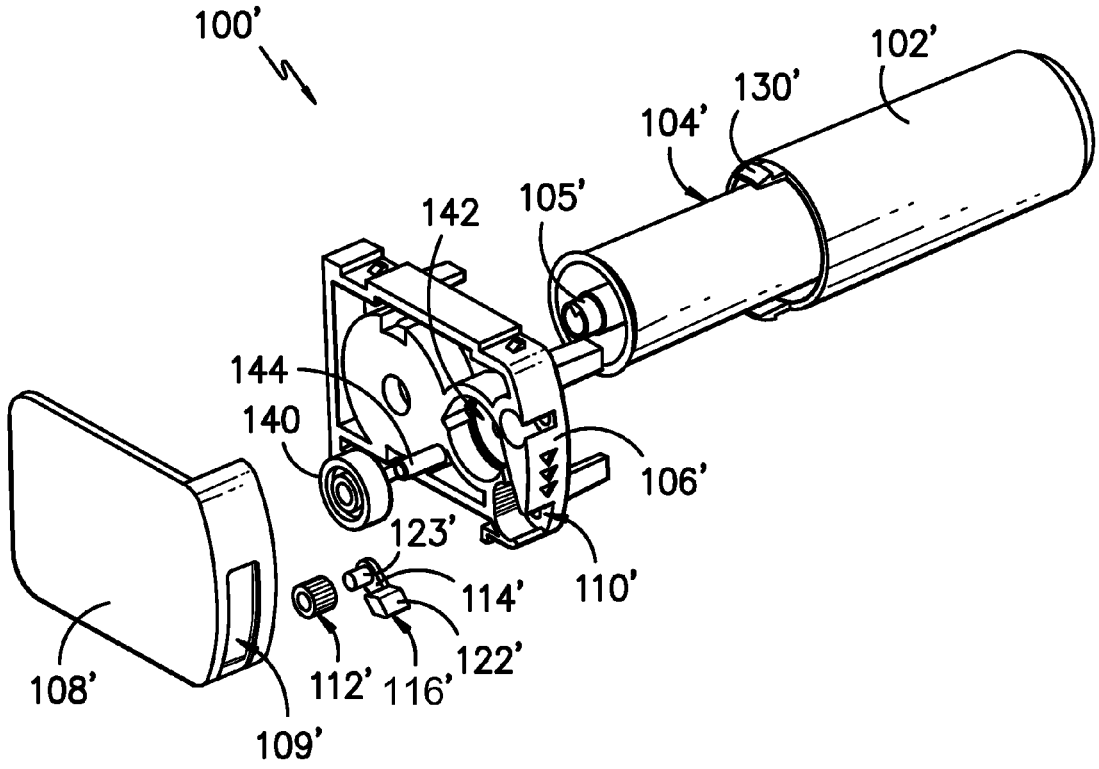
FIG. 16 provides an exploded perspective view of yet another cord lock assembly in accordance with exemplary aspects of the present disclosure.
Figure 17:
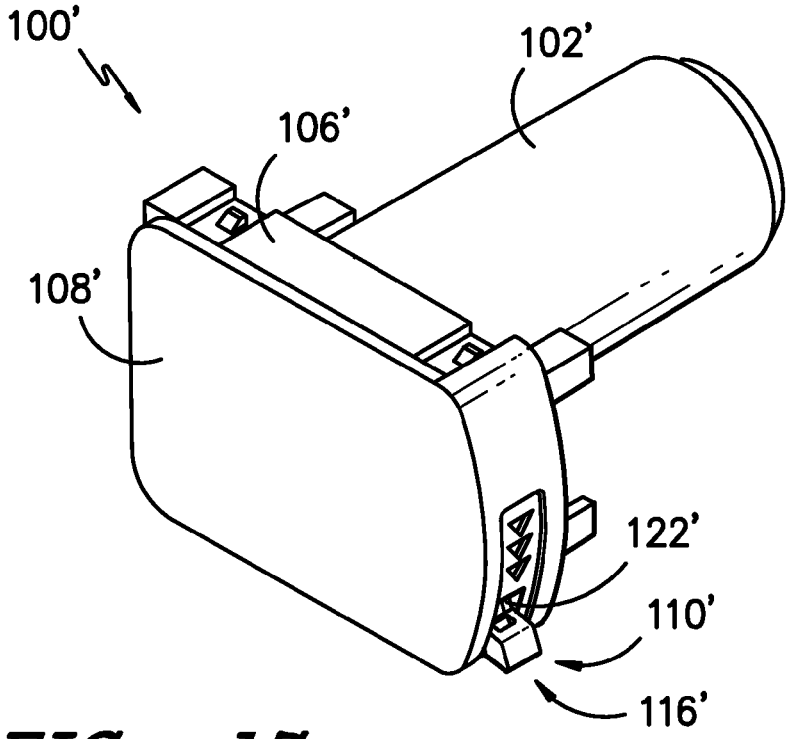
FIG. 17 provides an outside perspective view of the exemplary cord lock assembly of FIG. 16.
Figure 18:
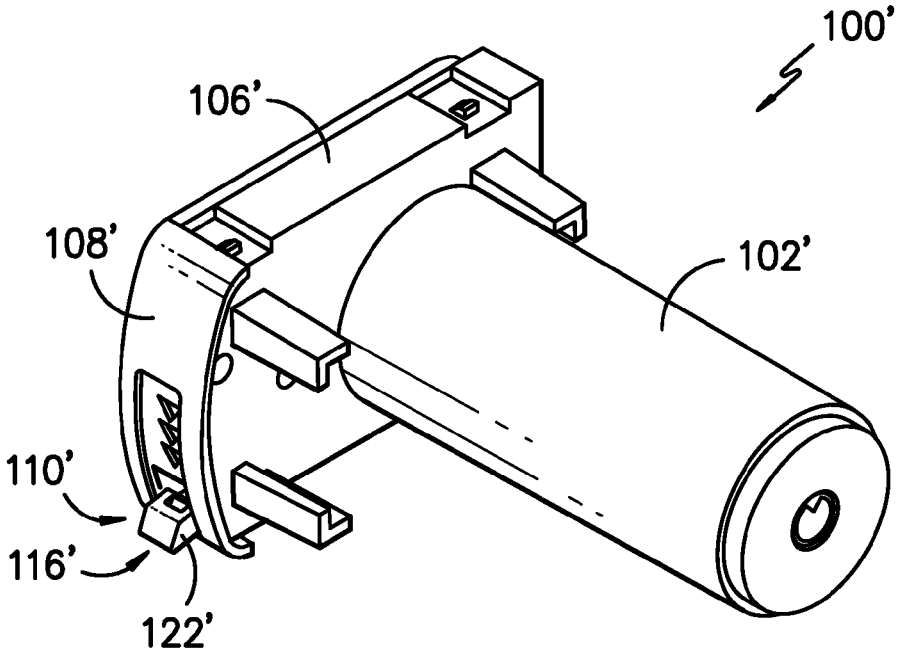
FIG. 18 provides an inside perspective view of the exemplary cord lock assembly of FIG. 16.
Figure 19:
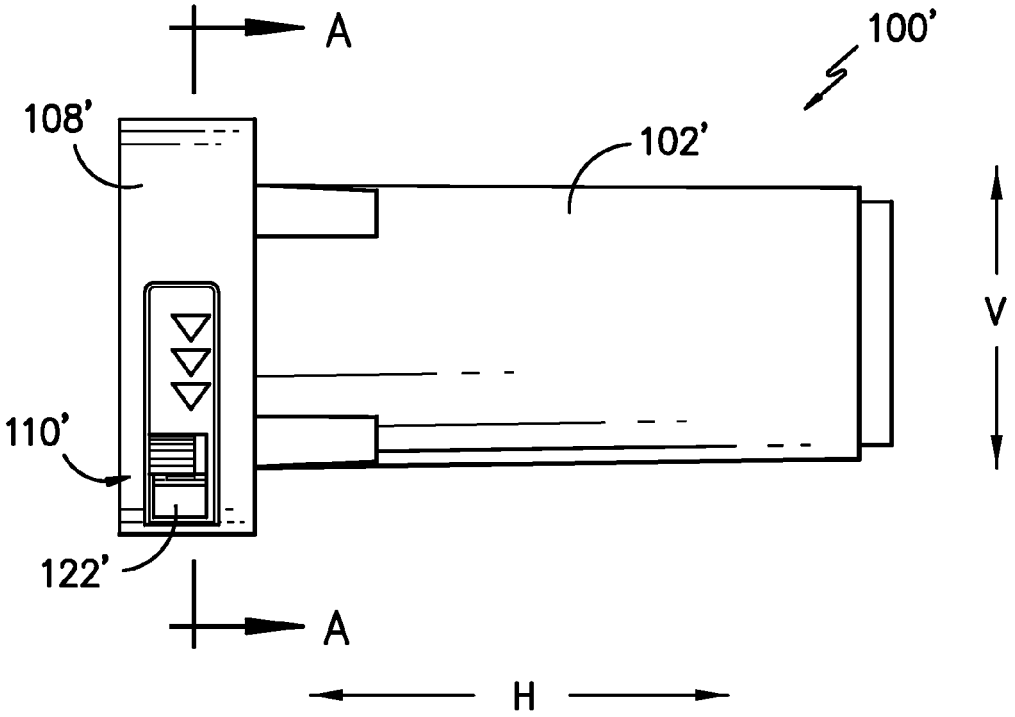
FIG. 19 provides a front view of the exemplary cord lock assembly of FIG. 16.
Figure 20:
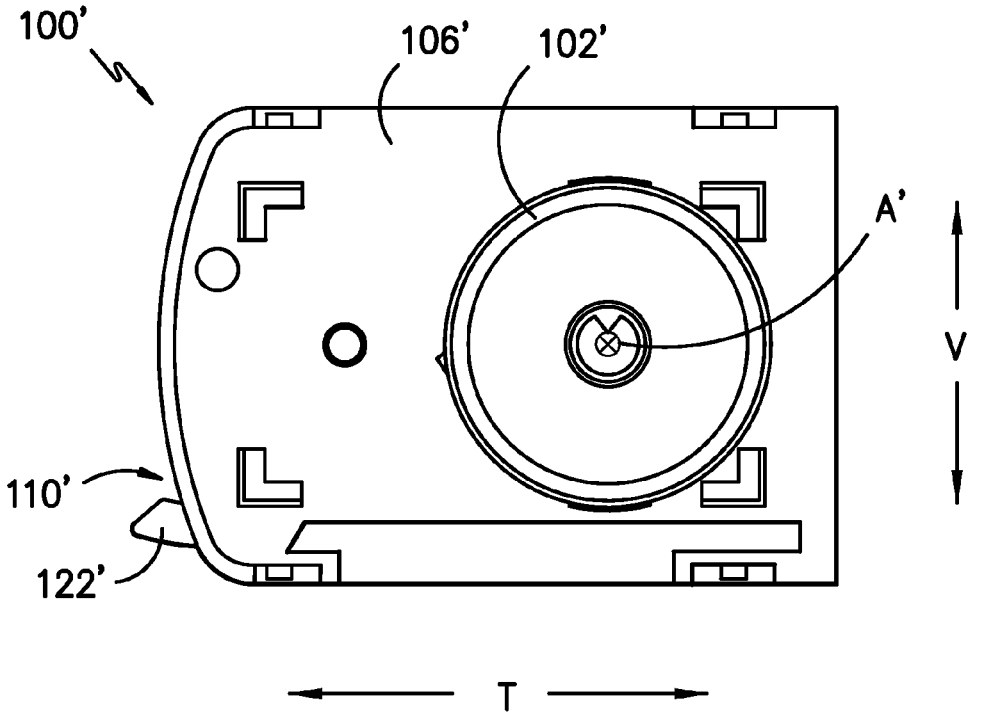
FIG. 20 provides an inside view of the exemplary cord lock assembly of FIG. 16.
Figure 21:
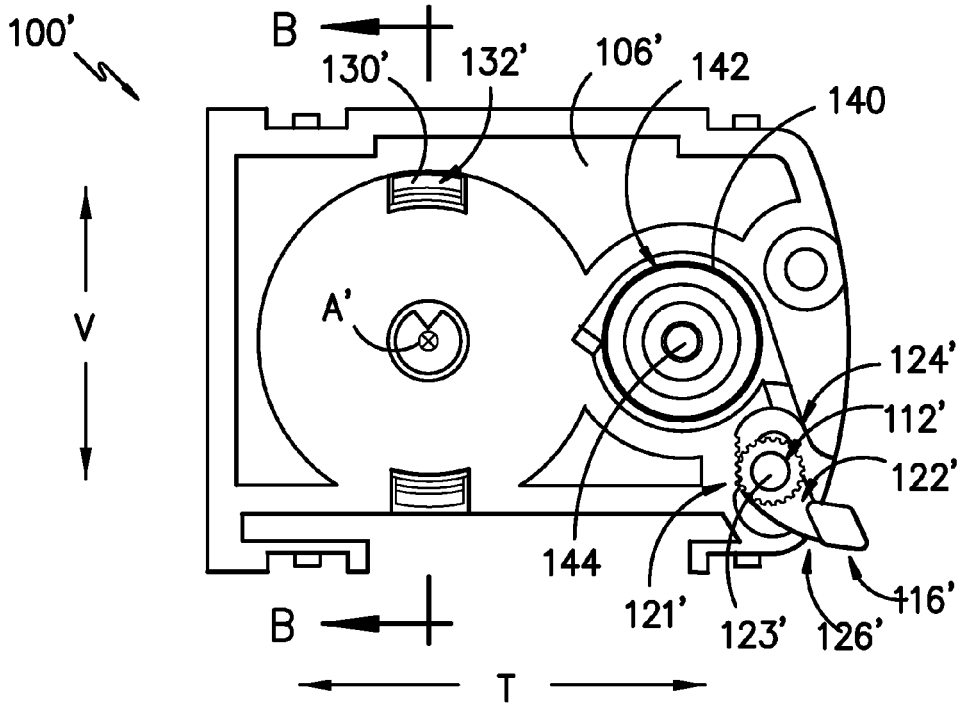
FIG. 21 provides an outside view of the exemplary cord lock assembly of FIG. 16 with the endcap removed.
Figure 22:
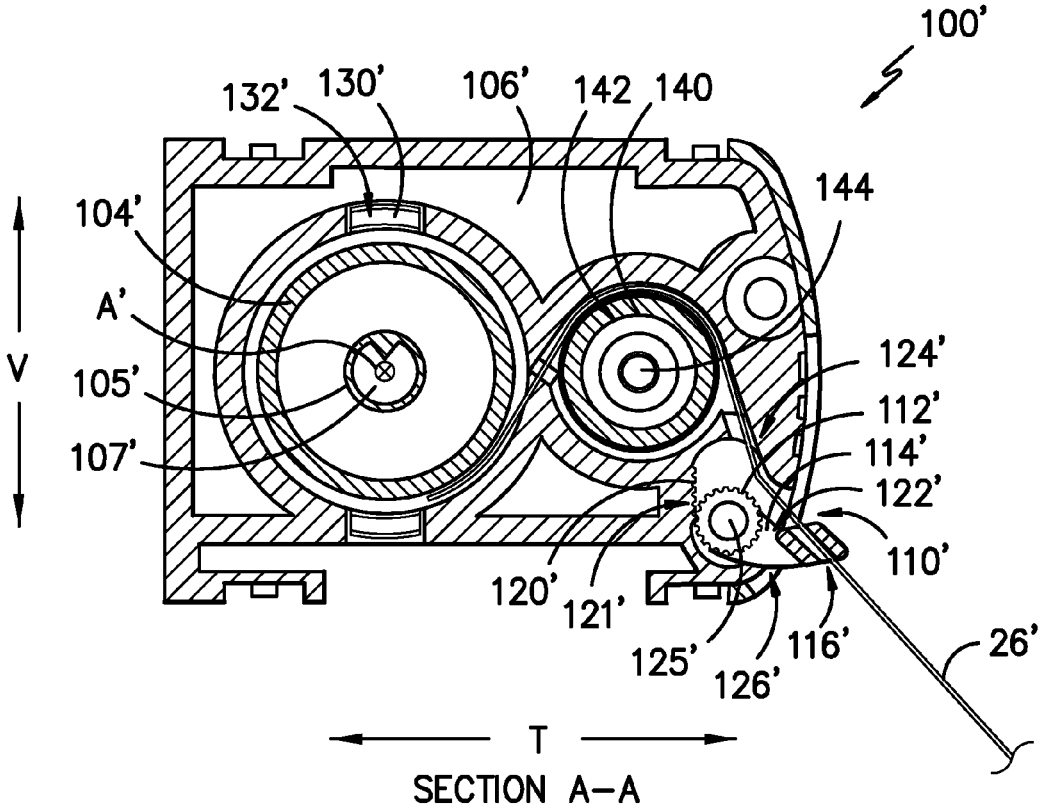
FIG. 22 provides an outside cross-sectional view of the exemplary cord lock assembly of FIG. 16, taken along line A-A of FIG. 19.

Referring now generally to FIGS. 16 through 23, yet another exemplary embodiment of the cord lock assembly 100 is provided. More particularly, FIGS. 16 through 23 provide an exemplary embodiment of the cord lock assembly 100' of FIGS. 1 through 3. For example, FIG. 16 provides an exploded perspective view of the exemplary cord lock assembly 100'. FIGS. 17 and 18 provide perspective views of the exemplary cord lock assembly 100' of FIG. 16-FIG. 17 provides an outside perspective view, and FIG. 18 provides an inside perspective view. Additionally, FIG. 19 provides a front view of the exemplary cord lock assembly 100' of FIG. 16 and FIG. 20 provides an inside view of the exemplary cord lock assembly 100' of FIG. 16. An outside side view of the exemplary cord lock assembly 100' of FIG. 16 (with the end cap 108 removed) is provided in FIG. 21. Additionally, an outside cross-sectional view of the exemplary cord lock assembly 100' of FIG. 16, taken along line A-A of FIG. 19, is provided in FIG. 22, and a front cross-sectional view of the exemplary cord lock assembly 100' of Ha 16, taken along line B-B of FIG. 21, is provided in FIG. 23.

The operation and configuration of the exemplary cord lock assembly 100' of FIGS. 16 through 23 is similar to the operation and configuration of the exemplary cord lock assembly 100 of FIG. 4. However, the exemplary cord lock assembly 100' of FIGS. 16 through 23 is mirrored as compared to the exemplary cord lock assembly 100 of FIG. 4, and the turning direction of the spool 104 is reversed. Such a construction may allow the exemplary cord lock assembly 100' of FIGS. 16 through 23 to be used in combination with the exemplary cord lock assembly 100 of FIG. 4 in, for example, a top-down bottom-up shade assembly, such as the exemplary shade assembly 10 of FIGS. 1-3. For example, the exemplary cord lock assembly 100 of FIG. 4 may be positioned on the right side 20 of the headrail assembly 14 and configured to control the bottom rail 18, and the exemplary cord lock assembly 100' of FIGS. 16 through 23 may be positioned on the left side 22 of the headrail assembly 14 and configured to control the intermediate rail 16.

Referring now specifically to FIG. 1.6, the turning direction of the spool 104 is reversed (as compared to the exemplary cord lock assembly 100 of FIG. 4) using an idler wheel 140 positioned in the housing 106 of the cord lock assembly 100' between the pull cord channel 110' and spool 104'. More particularly, the housing 106' of the exemplary cord lock assembly 100' of FIG. 16 includes an idler wheel recess 142 and an idler wheel pin 144. The idler wheel 140 is rotatably mounted in the idler wheel recess 142 on the idler wheel pin 144. The pull cord 26' accordingly may extend through the pull cord channel 110', wrap around an upper half of the idler wheel 140, and then extend down and around a lower end of the spool 104' and begin wrapping around the spool 104' (see FIG. 22). For the exemplary embodiment of FIG. 16, moving the pull cord 26' outwardly relative to the housing 15 of the headrail assembly 14 moves the idler wheel 140 clockwise and the spool 104' counter-clockwise when viewed from the outside perspective of FIG. 16. By contrast, without the idler wheel 140, moving the pull cord 26' outwardly relative to the body 15 of the headrail assembly 14 would rotate the spool 104' clockwise when viewed from the outside view of FIG. 16. Inclusion of a rotatable idler wheel 140 may reduce the amount of friction and resistance on the pull cord 26' when moving the pull cord 26' inwardly or outwardly relative to the body 15 of the headrail assembly 14 as the idler wheel 140 turns with the pull cord 26'.

It should be appreciated, however, that in other exemplary embodiments of the cord lock assembly 100' of FIG. 16, any other suitable configuration may be employed for reversing the turning direction of the spool 104'. For example, in other exemplary embodiments, the idler wheel 140 may instead be a stationary curved surface in the housing 106', a rounded pin in the housing 106', or any other suitable shape or construction.

Moreover, one of ordinary skill in the art will readily appreciate from the teachings herein that the exemplary shade assembly 10 and exemplary cord lock assemblies 100, 100' described and illustrated with respect to the FIGS. above may provide a method for locking and unlocking a rail in a shade assembly. For example, the method may include raising a rail in a shade assembly to a desired position by moving or pulling a pull cord outwardly relative to a body of a headrail assembly. The method may additionally include moving the pull cord inwardly relative to a central plane defined by the shade assembly such that an angle defined between the pull cord and the central plane of the shade assembly is less than a predetermined limit. Moving the pull cord inwardly relative to the central plane may further include moving with the pull cord a second end of a cam positioned in a pull cord channel defined by a housing of the cord lock assembly in a downward direction and/or in a direction towards the central plane of the shade assembly. Such a movement may in turn move a first end of the cam in a vertically upward direction due to an interaction of a rocker arm with a bottom ledge defined by the pull cord channel. Moreover, the method may include moving the pull cord inwardly relative to the body of the headrail assembly, such that the pull cord interacts with a roller rotatably attached to a pin at the first end of the cam, and pinching the pull cord between the roller and an upper wall of the pull cord channel. The interaction of the pull cord with the roller may cause the roller to rotate and move vertically upwards.

Furthermore, the method may additionally include moving the roller to an unlocked position. Moving the roller to the unlocked position may include moving the pull cord outwardly relative to the central plane of the shade assembly such that an angle defined by the pull cord and the central plane is greater than a predetermined limit. Additionally, moving the roller to the unlocked position may include moving the pull cord outwardly relative to the body of the head rail, such that the pull cord interacts with and rotates the roller vertically downward in the pull cord channel. The roller may then drop vertically downward in the pull cord channel into the unlocked position due to gravity.

It should be appreciated, however, in other exemplary aspects of the present disclosure, moving the roller to a locked position or an unlocked position may instead include moving the pull cord in a side to side direction. More particularly, moving the roller to a locked position or an unlocked position may include decreasing or increasing, respectively, an angle defined by the pull cord and a transverse plane defined by a vertical and transverse direction of the shade assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed:

1. A shade assembly for an architectural opening defining a vertical direction, the shade assembly comprising:

a shade;

a rail attached to the shade; and a headrail positioned above the rail, the headrail including a cord lock assembly, the cord lock assembly comprising:

a spool operably connected to the rail;

a housing defining a pull cord channel;

a pull cord extending through the pull cord channel and being partially wrapped around the spool;

a cam positioned at least partially within the pull cord channel, the cam including a rocker arm extending between a first end and a second end spaced apart from the first end, the cam including a roller coupled to the rocker arm such that the roller is rotatable relative to the earn about a rotational axis, the pull cord being configured to engage the rocker arm to actuate the cam between a locked position, wherein the pull cord is pinched between the roller and a locking surface defined within the housing, and an unlocked position, wherein the pull cord passes freely between the roller and the locking surface; and wherein the rotational axis for the roller is displaced within the pull cord channel in the vertical direction as the cam is actuated between the locked and unlocked positions.

2. The shade assembly of claim 1, wherein the shade is movable between a retracted position and an extended position, the shade defining a central plane when in the extended position that is oriented in the vertical direction and extends between opposed vertically extending sides of the shade;

wherein the pull cord is movable relative to the shade in a transverse plane extending perpendicular to the central plane; and When the pull cord is moved away from the shade along the transverse plane to an angle that exceeds an angular threshold, the cam is actuated to the unlocked position such that the roller is moved away from the locking surface to allow the pull cord to pass freely between the roller and the locking surface.

3. The shade assembly of claim 1, wherein the rocker arm is configured to interact with a bottom ledge of the pull cord channel as the cam is being actuated between the locked and unlocked positions.

4. The shade assembly of claim 1, wherein the roller defines a first plurality of ridges, and wall of the pull cord channel defines a second plurality of ridges, the first plurality of ridges on the roller being configured to interact with the second plurality of ridges on the wall as the cam is actuated between the locked and unlocked positions.

5. A shade assembly for an architectural opening defining a vertical direction, the shade assembly comprising:

a shade movable between a retracted position and an extended position, the shade defining a central plane when in the extended position that is oriented in the vertical direction and extends between opposed vertically extending sides of the shade;

a rail attached to the shade; and a headrail positioned above the rail, the headrail including a cord lock assembly, the cord lock assembly comprising:

a spool operably connected to the rail;

a housing defining a pull cord channel;

a pull cord extending through the pull cord channel and being partially wrapped around the spool, the pull cord being movable relative to the shade in a transverse plane extending perpendicular to the central plane;

a roller movable within the pull cord channel between a locked position and an unlocked position, the roller being rotatable within the pull cord channel about a rotational axis;

a cam positioned at least partially within the pull cord channel, the cam including a rocker arm extending between a first end and a second end spaced apart from the first end, the roller being rotatably coupled to the rocker arm; and when the pull cord is moved away from the shade along the transverse plane to an angle that exceeds an angular threshold, the rotational axis of the roller is displaced as the roller is moved to the unlocked position to allow the pull cord to pass freely through the pull cord channel.

6. The shade assembly of claim 5, wherein, when the pull cord is moved towards the shade along the transverse plane to a different angle that is less than the angular threshold, the rotational axis of the roller is displaced as the roller is moved to the locked position, the pull cord being pinched between the roller and a locking surface defined within the housing when the roller is in the locked position.

7. The shade assembly of claim 5, wherein the cam includes a pin positioned at or adjacent to the first end of the rocker arm, the roller being positioned on the pin such that the pin defines the rotational axis for the roller.

8. The shade assembly of claim 5, wherein the pull cord is configured to engage the cam at or adjacent to the second end of the rocker arm to move the roller between the locked and unlocked positions.

9. The shade assembly of claim 8, wherein the pull cord extends through a pull cord slot defined by the cam at or adjacent to the second end of the rocker arm.

10. The shade assembly of claim 5, wherein the angular threshold corresponds to an angle defined within the transverse plane relative to the vertical direction that ranges from 15 degrees to 60 degrees.

11. The shade assembly of claim 1, wherein the roller is located at or adjacent to the first end of the rocker arm, and the pull cord is configured to engage the rocker arm at or adjacent to the second end to actuate the cam between the locked and unlocked positions.

12. The shade assembly of claim 11, Wherein the pull cord extends through a pull cord slot defined by the cam at or adjacent to the second end of the rocker arm.

13. The shade assembly of claim 1, wherein the rotational axis of the roller is displaced vertically along a first wall of the housing as the cam is actuated between the locked and unlocked positions, the locking surface being defined by a second wall of the housing spaced apart from the first wall.

14. The shade assembly of claim 2, Wherein, when the pull cord is moved towards the shade along the transverse plane to a different angle that is less than the angular threshold, the rotational axis of the roller is displaced as the cam is actuated to the locked position such that the roller is moved towards the locking surface and the pull cord is pinched between the roller and the locking surface.

15. The shade assembly of claim 3, wherein the rocker arm defines a curved profile between the first and second ends such that the interaction between the rocker arm and the bottom ledge of the housing results in the rotational axis of the roller being displaced within the pull cord channel.

* * * * *